United States Patent [19]

Graf

[11] Patent Number: 4,532,967

[45] Date of Patent: Aug. 6, 1985

[54] METERING PUMP, AS WELL AS PROCESS AND APPARATUS FOR FILLING A CONTAINER EQUIPPED WITH A METERING PUMP

[75] Inventor: Lothar Graf, Rielasingen, Fed. Rep. of Germany

[73] Assignee: Firma Ing. Erich Pfeiffer GmbH & Co. KG, Fed. Rep. of Germany

[21] Appl. No.: 511,106

[22] Filed: Jul. 6, 1983

[30] Foreign Application Priority Data

Jul. 9, 1982 [DE] Fed. Rep. of Germany ..... 3225692

[51] Int. Cl.[3] ..... B65B 3/04

[52] U.S. Cl. ..... 141/3; 141/20; 53/492; 222/321; 222/383; 417/435

[58] Field of Search ..... 141/1–12, 141/37–69, 285–310; 417/435, 199 A; 222/321, 383, 385; 53/88, 97, 470, 492

[56] References Cited

U.S. PATENT DOCUMENTS

| | | | |
|---|---|---|---|
| 920,121 | 5/1909 | Farmer . | |
| 3,835,896 | 9/1974 | Smrt | 141/3 |

FOREIGN PATENT DOCUMENTS

| | | |
|---|---|---|
| 25224 | 3/1981 | European Pat. Off. . |
| 153694 | 4/1903 | Fed. Rep. of Germany . |
| 1782302 | 8/1971 | Fed. Rep. of Germany . |
| 2706800 | 8/1977 | Fed. Rep. of Germany . |
| 393653 | 11/1965 | Switzerland . |
| 711879 | 7/1954 | United Kingdom . |

*Primary Examiner*—Houston S. Bell, Jr.
*Attorney, Agent, or Firm*—Steele, Gould & Fried

[57] ABSTRACT

A method and apparatus for pre-charging the pump chamber of a discharge pump on a container such as a fluid atomizer primes the pump for dependable operation thereafter. The method includes opening the outlet valve of the discharge pump by operating the pump to its full displacement, and applying a vacuum to draw container contents into the pump chamber, just up to the outlet valve. The apparatus for practicing the method includes a controllable vacuum head adapted to engage an outlet channel of the container, the vacuum head also being movable to engage and move the pump. The apparatus can incorporate an indexing feeding arrangement for delivering articles to the vacuum head, and a blast of pressure may be applied upon completing the process, to release the containers from the vacuum head and securely close the pump outlet valve.

17 Claims, 5 Drawing Figures

METERING PUMP, AS WELL AS PROCESS AND APPARATUS FOR FILLING A CONTAINER EQUIPPED WITH A METERING PUMP

BACKGROUND OF THE INVENTION

The present invention relates to a process an apparatus for filling a container equipped with a metering or atomizing pump, with a filling medium to be dispensed, particularly a liquid, pasty or gel-like filling medium, in which the container is filled and subsequently the pump is tightly fitted to the container opening. The invention also relates to a metering pump, which is filled in a special way.

In the case of such metering pumps, it is often difficult, particularly with highly viscous liquids, pasty or gel-like media, to operate the pump on the first occasion, because the pump has some difficulty in sucking in the material to be discharged. This is disturbing to the user and can lead to the pump being looked upon as defective. When used pharmaceutically, it can lead to impatience on the part of the user, resulting in incorrect operation.

It is conventional practice after manufacture, of perfume atomizers but before fitting them to a container, to test the perfume atomizers by operating the pump with a test liquid (alcohol solution), which is then removed from the pump again.

SUMMARY OF THE INVENTION

The object of the present invention is to so prepare a metering or atomizing pump prior to its first use that it adequately functions after only one or a few operating strokes.

According to the invention, after filling the container and the fitting the pump, e.g., by screwing on the one hand device is operated in such a way that the outlet valve opens and on the other hand the opening of the outlet passage is connected to a source of relatively low pressure, compared with the container pressure. The lower pressure is called vacuum here. Thus, accompanied by the automatic opening of the inlet valve of the pump chamber, the medium is sucked up into the pump chamber. It has surprisingly been found that a pump filled in this way retains the filling in its pump chamber, even after a very long time and fulfils its function during the first or second operating strokes.

The use of a vacuum, in place of the suction produced by operating the pump, not only leads to a considerable time saving, but offers many other advantages. Preferably, sucking of material into the pump only takes place up to the outlet valve. The extent of the vacuum, its acting time and the passage cross-section of the outlet passage located downstream of the outlet valve can advantageously be dimensioned in such a way that during the sucking in of material little or no filling medium penetrates the outlet passage. Although the vacuum must be adequate to ensure a rapid filling of the pump chamber through the inlet valve, the volume resistance of the outlet valve, the size of the vacuum and its action time are matched to one another in such a way that the medium cannot flow away over the inlet valve. The particular values for the reference quantities are dependent on the constructional conditions of the pump and the viscosity of the filling medium.

Due to the fact that the outlet passage remains free, the filling medium cannot dry and clog the outlet passage and a spray diffuser or atomizer possibly provided thereon. There is also no contamination of the medium left behind in the outlet passage.

The invention is particularly suitable for metering and atomizing pumps, which produce a very high pressure of several bars and build up this pressure in the pump chamber, before the outlet valve opens. In the case of such pumps, the outlet valve cross-section is so small, that the aforementioned requirements can easily be fulfilled. However, in the case of such pumps, the vacuum alone is not adequate for opening the outlet valve. Thus, with such pumps, the outlet valve must be opened by external actuation. This can be brought about by operating the pump piston, which acts as an outlet valve component by means of an elastic portion. The piston is moved against a fixed stop, so that the outlet valve opens. Such a pump construction is, for example, described by European Patent No. 0,025,224.

The process can easily be performed by means of the apparatus described hereinafter and only takes up very little time.

BRIEF DESCRIPTION OF THE DRAWINGS

The invention is described in greater detail hereinafter relative to non-limitative embodiments and the attached drawings, wherein.

DETAILED DESCRIPTION OF THE INVENTION

Figure 1:
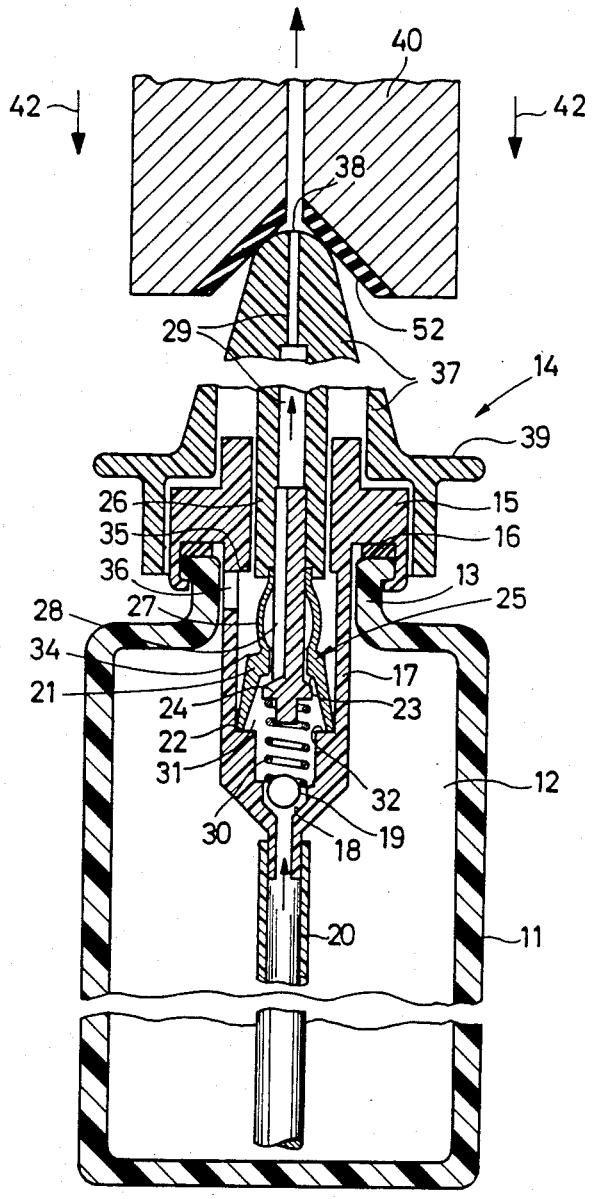
FIG. 1 is a vertical section through a metering pump mounted on a container in connection with part of a preferred apparatus for performing the process.

FIG. 1 shows a container 11, which is filled with a filling medium 12. The medium 12 is a liquid, pasty or gel-like medium, particularly for cosmetic or pharmaceutical use, e.g. a gel to be sprayed into a patient's nose. The invention is particularly suitable for such gels, pastes or highly viscous liquids.

A metering or atomizing pump 14 is tightly fitted onto the container opening 13. In the represented embodiment this is done by snapping on a pump base part 15, whilst interposing a packing 16. The pump and virtually all its components are made from plastic. To improve manufacture, certain of the parts shown here in one piece for simplification purposes, e.g. base part 15, are actually made from several joined individual parts.

The pump has a pump cylinder 17, on whose lower end is shaped a seat 18 for a spherical inlet valve 19. The downwardly leading inlet passage is connected to a flexible suction tube 20, which projects into the container. In pump cylinder 17 runs a flexible material piston 21, which is overall constructed as a sleeve, whose lower sealing lips 22 engage on the pump cylinder wall. A central portion 23 of the piston 21, surrounding the inner opening of the piston 21, together with a conical valve seat body 24 forms the outlet valve 25 of the single-acting piston pump. The valve seat body 24 is pressed into a hollow piston rod 26 and is also surrounded by an upper-hose like piston portion forming an elastic collar 27, whose upper end is tightly secured to piston rod 26. The mounting of the piston takes place in such a way that in the inoperative state, elastic collar 27 is prestressed outwards, accompanied by an outward bulging, and consequently exerts a closing force on the outlet valve formed between parts 24 and 25. The valve seat body 24 has a plurality of slots 28 on its outer periphery, which are connected to the remainder of the outlet passage 29 formed in the hollow piston rod. A helical return spring 30 acts on the valve seat body 24 and attempts to force the single-acting pump into its inoperative position and simultaneously prevents the uncontrolled penetration of the spherical outlet valve into pump chamber 31.

At the end of the cylinder path in the pump cylinder, there is a step 32, against which the sealing lips 22 of the piston abut when the end of the pump stroke is reached. This state is shown in FIG. 1. Accompanied by the further compression of elastic collar 27, piston part 23 is raised from the valve seat body 24 and consequently outlet valve 25 is opened.

In the inoperative position of the pump (not shown in FIG. 1), an outer packing cone 34 of the piston engages on an upper step 35 of the pump cylinder and seals the pump chamber and in particular an air compensating opening 36, which is in the form of an interruption in the pump cylinder wall. Thus, in the inoperative state, the pump is completely closed to the outside, whereas in the operating state a quantity of air corresponding to the volume to be dispensed can flow from the outside into the container.

An operating pusher containing outlet passage 29 is connected to piston rod 26 and which can also be constructed as an interchangeable adapter. In accordance with its function, it can have the most varied designs and can be provided with straight outlet passages, spray nozzles, etc. In the present case, it is an elongated, conical adapter, shown broken away, with a straight outlet port 38, which has at its pump end a wide step 39 for supporting the finger on depressing the operating pusher.

The container is received in an apparatus 41 and, in its upright position, is positioned relative to a suction head 40 which can be pressed downwards from above onto the pump, in the direction of arrow 42. The apparatus is shown in detail in FIGS. 2 and 3.

Figure 2:
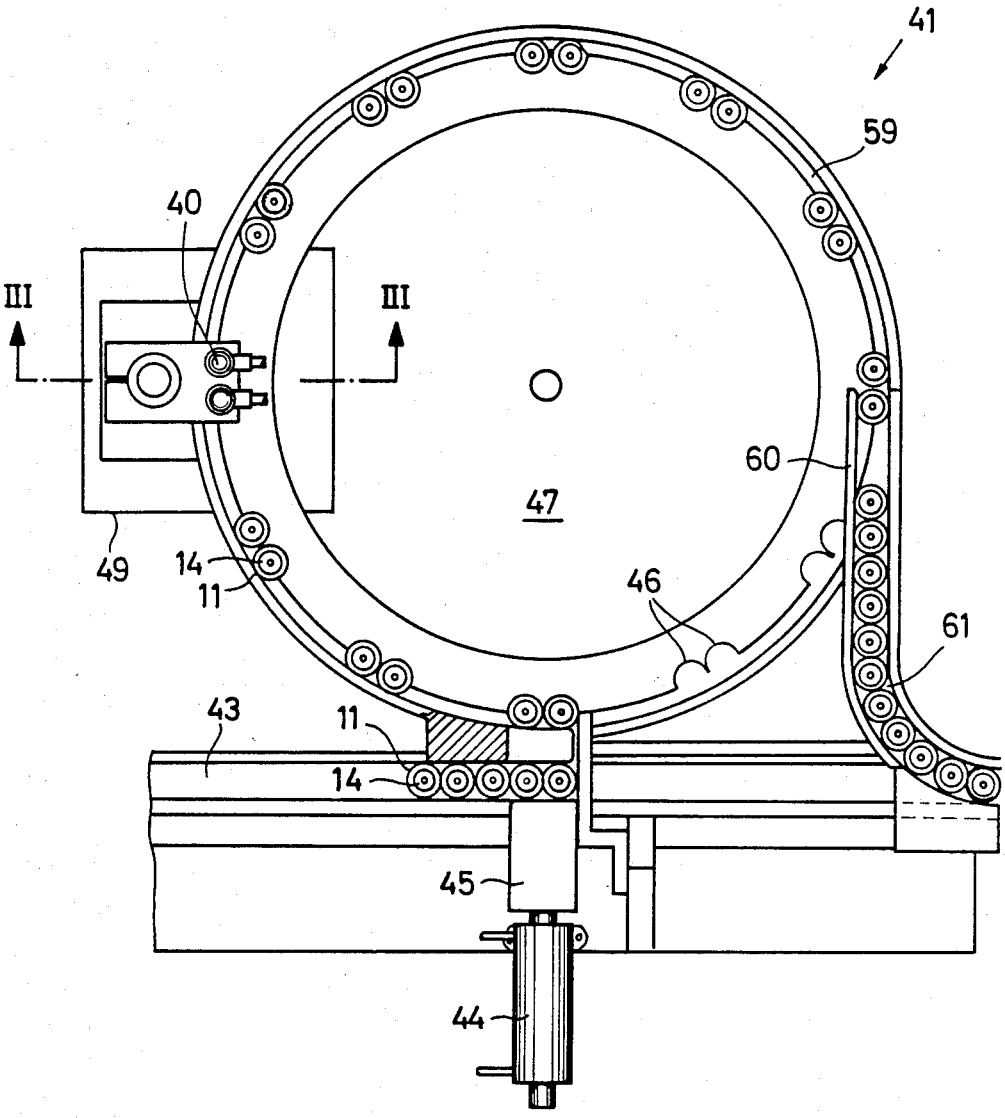
FIG. 2 is a plan view of the apparatus.

FIG. 2 shows apparatus 41 in plan view and constitutes a machine, which in a production sequence for filling container 11 and fitting the pump, can be connected to the latter. The filling and fitting stations are not shown here.

The filled containers 11, equipped with a pump, arrive in a feed channel 43 and, by means of a slide 45 operated by a pneumatic cylinder 44, are moved in pairs into two hemispherical recesses 46 on the outer circumference of a horizontally arranged, stepwise rotatable disk 47. With a certain spacing, the disk is surrounded by a circularly arranged L-profile 48 (FIG. 3), which forms a support and circular guide for containers 11. Thus, the containers are in each case conveyed round in a circle in pairs with the stepwise rotation of disk 47. The disk carries numerous, e.g. 12 pairs of equidistantly spaced recesses and the stepping drive in each case advances by one spacing (1/12th rotation). Two suction heads 40 are provided at a suction station 49 for simultaneously processing the pair of containers.

Figure 3:
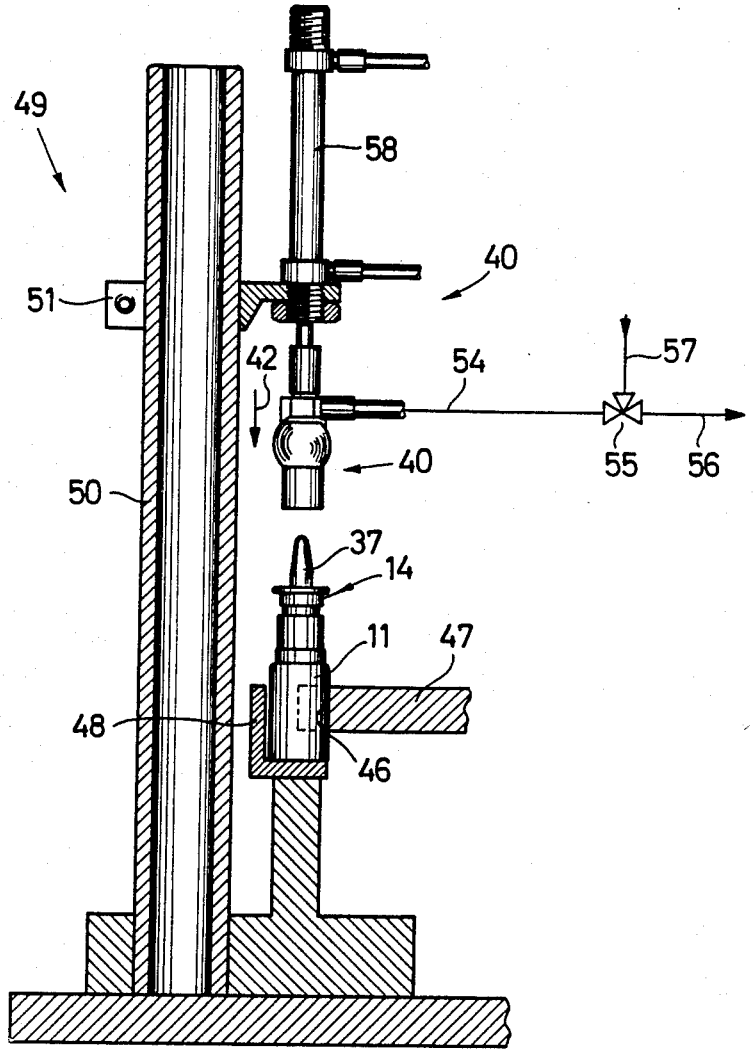
FIG. 3 is a partial section through the apparatus along line III—III of FIG. 2.

As can be gathered from FIG. 3, a guide post 50 is provided at suction station 49. The two suction heads 40 on a support 51 are received in juxtaposed and vertically adjustable manner on said guide post 50.

The lower end of each suction head has in the present embodiment a conical mounting 52 for the operating pusher in the opening area (cf FIG. 1). This mounting can be arranged in a random manner corresponding to the outlet passage openings 38 and the operating pusher design. It serves to depress the operating pusher and simultaneously produce a sealed connection between the outlet passage 29 and the suction head.

The suction channel in suction head 40 is connected via a line 54 to a control device 55, which is represented as a three-way valve and, as a function of the overall control of the apparatus, can be connected either to a vacuum line 56 or to a compressed air line 57. A pneumatic cylinder 58 is operated by the overall apparatus control system and moves suction head 40 up and down.

A rail 60 engaging in the circular guide path for the container is provided opposite suction station 49. Rail 60 removes the container from the wheel and guides it to a discharge conveyor belt 61, from where the now finished containers can be conveyed away for packing and transportation.

The operation of the apparatus and the process according to the invention will now be described.

The containers 11, filled with medium are provided with a pump and moved by slide 45 into the recesses 46 of disk 47 constituting a circular table, are conveyed in stepwise manner to suction station 49. It is pointed out here, that if required, there can also be a different number of containers, e.g. three or four, which can be processed in parallel and/or further processing stages can be carried out on the circular table, e.g. affixing labels or the like.

Disk 47 places the containers beneath the particular suction heads 40, and the latter are moved downwards by the pneumatic cylinders 58, so that the mounting 52, which may be provided with a packing, rests on the operating pusher and forces the latter down until it has reached the position shown in FIG. 1, in which the sealing lip 22, or in different constructions some other part of the piston, engages on step 32 and, whilst overcoming the pretension of elastic collar 27, opens outlet valve 25. Simultaneously, the suction line 43 is applied to the vacuum line 56, so that by means of outlet passage 29, slots 28 and outlet valve 25, a suction action is produced in pump chamber 31 and as a result the filling medium 12 is sucked into said chamber via suction tube 20 and inlet valve 18, 19. Due to the relatively large cross-sections in the filling medium suction path, the filling of the pump chamber is finished in a very short time (approx. 2/10 sec). There is no further suction of the filling medium through the outlet valve into the outlet passage, because the vacuum is so dimensioned as a function of the outlet valve cross-section and the viscosity of the medium that a flow through the outlet valves would take up a much longer time.

Subsequently, the suction head 40 is simultaneously raised again by operating the pneumatic cylinder and by switching over control device 55, a very short compressed air blast is applied to the suction head. As a result, the outlet valve is reliably and very rapidly closed by reverse pressurization, before any filling medium which has passed through the outlet valve has been forced back again (but this does not normally occur) and finally it is reliably ensured that the operating pusher is made free from the suction head 40. However, it has been found, that the apparatus also operates successfully without any compressed air blast.

During the upward movement of the pump, under the action of return spring 33, the pump chamber is now filled. As can be gathered from FIG. 1, during vacuum action only the clearance volume of the pump is filled, whereas the actual stroke volume is only filled during the following automatic upward movement. During these phases, the air compensating channel containing opening 36 is opened. It is closed again at the end of the upward stroke by the engagement of bevel or slope 34 against step 35.

Due to the fact that only the clearance volume of the pump has to be filled by vacuum action, a very short operating time is possible. The cycle time is only 0.3 seconds for the advancing of the circular table, the positioning of the containers and the suction and pressure process, so that the apparatus is able to process approximately 10,000 containers per hour.

Figure 4:
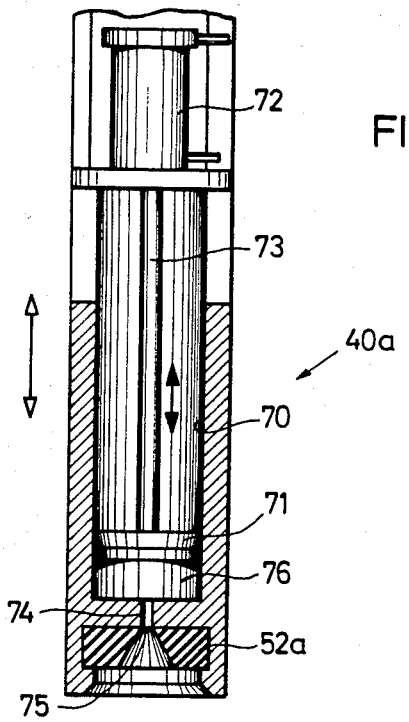
FIGS. 4 and 5 are section views through details of an apparatus, which is preferred for certain filling media or conditions.

FIG. 4 shows a detail of a suction head 40*a*, which, following onto the sealing mounting 52*a*, has a pump cylinder 70 with a single-acting piston 71. The suction head, which can be moved up and down as a whole in the aforementioned manner, contains an additional pneumatic cylinder 72, which moves the piston rod 73 of piston 71 up and down. The stroke of piston 71 is adjustable.

In the cylinder, the piston defines a vacuum chamber 76 connected via a suction channel 74 to the suction head opening 75 in mounting 52*a*. By operating pneumatic cylinder 72, after pressing the suction head onto the opening of the pump outlet passage, the volume of vacuum chamber 76 is increased by an amount, which roughly corresponds to the amount of liquid to be subsequently sucked in. Thus, only sufficient filling medium is sucked into the pump as ensures the desired fill height, e.g. up to the outlet valve of the pump. The increase in the volume of the vacuum chamber can be somewhat larger in order to ensure the desired fill height in the pump, despite any flow resistances and volume changes, resulting from geodesic height differences. During the return stroke, the sucked in air is forced out via the piston.

This embodiment ensures that the pump is only filled to the desired extent in the case of very thin liquid, which could flow relatively easily through the pump outlet valve. This also applies for other filling media, in the case of a correspondingly large outlet valve cross-section.

Figure 5:
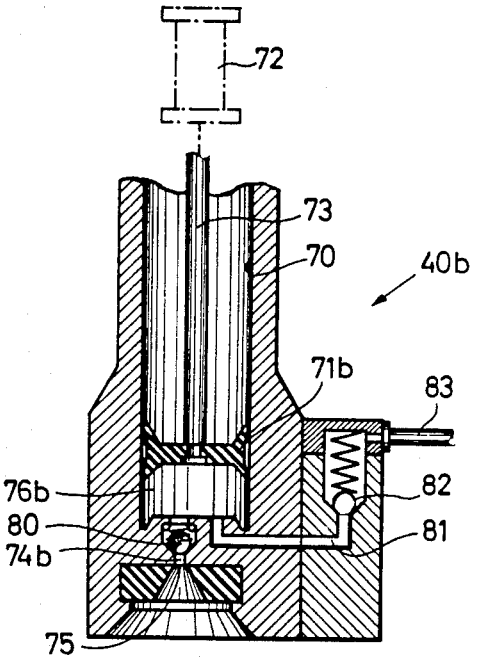

FIG. 5 shows a construction in which the suction head 40*b* also has a cylinder 70 and a piston rod 73 operable by a pneumatic cylinder 72. The piston 71*b* is equipped with two sealing lips, so that it seals during the upward and downward stroke. In suction channel 74*b* is fitted a valve 80, which serves as an inlet valve for the pump formed by cylinder 70 and piston 71*b*. From beside the inlet valve, passes an outflow channel 81, which by means of a spring-loaded ball valve 82, opening in the discharge direction, passes into a drain line 83.

Thus, here again, suction takes place by means of an upward movement of piston 71*b*, whose stroke is optionally adjustable. If in this case, filling media pass out of the pump outlet passage and flows into the vacuum chamber 76*b* via valve 74*b*, it flows away again via outlet valve 82 and drain line 83 during the return stroke of piston 71*b*, which fits into the cylinder relatively free from any clearance. This ensures that even when excess filling medium is sucked up, it can be drained away on a prescribed path and cannot contaminate the containers or the machine.

Although the constructions according to FIGS. 4 and 5 show piston pumps, it is possible to use any other type of vacuum chamber, which can vary their volume in a planned manner, e.g. diaphragms, etc. Operation can take place in any random manner, i.e. also mechanically. It could also be connected to the suction head operation in that, after performing a suction head travel, the pump is connected to the stroke of pistons 71, 71*b* for depressing the operating pusher. This saves an operating element. The liquid passing out of drain line 83 can be returned to the filling station or to a storage vessel. It would also be possible to allow the suction pump shown in FIGS. 4 and 5, provided that it is equipped with inlet and outlet valves, to perform the suction process in several strokes. In this case, the desired quantity could be set through the number of strokes. However, normally the volumes to be sucked in are so small that then the pump dimensions would be too small.

In addition to, or instead of the construction according to FIG. 5, between the suction head opening and the vacuum pump or an associated part, it would be possible to incorporate a separator for entrained filling medium, which prevents contamination of the valve or pump. However, in both FIGS. 4 and 5 and the remaining constructions, a limited clearance between the suction head opening and the vacuum source is advantageous.

What is claimed is:

1. A process for filling a container provided with a discharge pump having a pump chamber and an outlet valve in an outlet passage thereof, and a filling medium to be disposed from the container, comprising the steps of:

filling the container with the filling medium;

fitting the pump tightly to an opening in the container;

opening the outlet valve of the pump;

exerting a vacuum on the outlet passage to draw the filling medium into the pump chamber; and, closing the outlet valve to thereby maintain the filling medium in the pump chamber.

2. The process according to claim 1, wherein said exerting of vacuum on the outlet passage draws in filling medium only up to the outlet valve.

3. The process according to claim 2, wherein the extent of the vacuum exerted, the time of said exerting of the vacuum and the passage cross-section of the outlet passage downstream of the outlet valve are dimensioned such that, during said exerting of vacuum, filling medium is sucked just up to the outlet passage.

4. The process according to claim 1, further comprising a step of momentarily applying pressure on the outlet passage after said exerting of vacuum.

5. The process according to claim 1, wherein the pump is a reciprocating pump, and wherein said opening is accomplished by operating the pump to an end stop thereof, prior to the exerting of vacuum.

6. The process according to claim 1, wherein the exerting of vacuum is adapted to move a volume essentially limited to a quantity of filling medium to be sucked into the pump chamber.

7. An apparatus for filling containers, each container provided with a discharge pump having a pump chamber and an outlet passage having an outlet valve, and a filling medium to be dispensed through the pump, comprising:

means for filling the container and tightly fitting the pump to an opening in the container;

a vacuum suction head, arranged in movable manner relative to the pump and operative to apply a vacuum to the pump outlet passage opening.

8. The apparatus according to claim 7, wherein the suction head is movable against the pump to displace an operating element of the the pump up to an end stop of the pump.

9. The apparatus according to claims 7 or 8, further comprising a controllable source of compressed air, as well as a controllable source of vacuum, said sources being connected to the suction head.

10. The apparatus according to claim 8, wherein the suction head is movably pressed onto the pump of the container by means of a pneumatic cylinder.

11. The apparatus according to claim 7, further comprising a circular table for receiving a plurality of containers sequentially, the table being discontinuously movable to convey the containers past at least one suction head.

12. The apparatus according to claim 7, further comprising a variable volume vacuum chamber operative to suck the filling medium into the pump chamber, the vacuum chamber being connected to the suction head.

13. The apparatus according to claim 12, wherein the vacuum chamber is a suction cylinder having an adjustable stroke.

14. The apparatus according to claim 12, further comprising a drain line for receiving excess filling medium drawn through the pump chamber, the drain line having an outlet valve connected to the vacuum chamber and an inlet valve connected between the suction head and the vacuum chamber.

15. A device comprising a discharge pump fitted to a container filled with a medium to be dispensed, wherein a pump chamber of the pump is pre-charged with the medium up to an outlet valve thereof prior to an initial use of the pump and an outlet passage downstream of the outlet valve in a discharge direction is substantially free from the filling medium.

16. The process according to claim 1, wherein the filling medium is a viscous liquid.

17. The device according to claim 15, wherein the filling medium is a viscous liquid.

* * * * *